US009291403B2

(12) United States Patent
Hisanaga et al.

(10) Patent No.: US 9,291,403 B2
(45) Date of Patent: Mar. 22, 2016

(54) HEAT EXCHANGER

(75) Inventors: Toru Hisanaga, Hamamatsu (JP); Yoshihiro Umeda, Hamamatsu (JP); Tamaki Kuniyoshi, Hamamatsu (JP)

(73) Assignee: YUTAKA GIKEN CO., LTD. (JP)

( * ) Notice: Subject to any disclaimer, the term of this patent is extended or adjusted under 35 U.S.C. 154(b) by 1326 days.

(21) Appl. No.: 13/065,787

(22) Filed: Mar. 30, 2011

(65) Prior Publication Data

US 2011/0240270 A1 Oct. 6, 2011

(30) Foreign Application Priority Data

Mar. 31, 2010 (JP) ..... 2010-083967

(51) Int. Cl.

| | |
|---|---|
| ***F28F 1/40*** | (2006.01) |
| ***F28D 7/16*** | (2006.01) |
| ***F28F 3/02*** | (2006.01) |
| *F28D 21/00* | (2006.01) |

(52) U.S. Cl.

CPC ..... *F28F 1/40* (2013.01); *F28D 7/1684* (2013.01); *F28F 3/027* (2013.01); *F28D 21/0003* (2013.01)

(58) Field of Classification Search

CPC ..... F28F 1/40

USPC ..... 165/4, 10, 153, 157, 158, 166, 170, 165/177, 181, 183, 200, 287, 296, 297, 299, 165/100, 103

See application file for complete search history.

(56) References Cited

U.S. PATENT DOCUMENTS

| | | | | |
|---|---|---|---|---|
| 3,532,157 | A * | 10/1970 | Hubble | 165/8 |
| 4,518,544 | A * | 5/1985 | Carter et al. | 261/112.2 |
| 6,190,624 | B1 * | 2/2001 | Romatier | 422/200 |
| 6,334,769 | B1 * | 1/2002 | Retallick et al. | 431/7 |
| 6,595,274 | B2 * | 7/2003 | Hayashi et al. | 165/158 |
| 6,869,578 | B1 * | 3/2005 | Hebert et al. | 422/198 |
| 7,490,580 | B2 * | 2/2009 | Hanai et al. | 122/31.1 |
| 7,571,759 | B2 * | 8/2009 | Inagaki et al. | 165/80.4 |
| 7,984,753 | B2 * | 7/2011 | Ohfune et al. | 165/166 |
| 2006/0196632 | A1 | 9/2006 | Kudo | |
| 2010/0243225 | A1 * | 9/2010 | Zobel et al. | 165/177 |

FOREIGN PATENT DOCUMENTS

| | | | |
|---|---|---|---|
| DE | 102006033570 | | 1/2008 |
| DE | 102006033570 | A1 * | 1/2008 |
| JP | 2001241872 | | 9/2001 |
| JP | 2005180714 | | 7/2005 |
| JP | 2009299968 | | 12/2009 |
| JP | 2009299968 | A * | 12/2009 |

* cited by examiner

*Primary Examiner* — Marc Norman
*Assistant Examiner* — Devon Russell
(74) *Attorney, Agent, or Firm* — Adams & Wilks

(57) ABSTRACT

A heat exchanger has a core case, at least one fin case disposed in the core case, and pair of upper and lower fins disposed in the fin case. The fin case has an inlet part, an outlet part, and a middle part disposed between the inlet and outlet parts. Each of the upper and lower fins has top and bottom portions. The upper and lower fins are disposed within the fin case so that the upper and lower fins are not in contact with each other at the inlet and outlet parts of the fin case and so that the bottom portions of the upper fin are in contact with respective ones of the top portions of the lower fin at the middle part of the fin case.

16 Claims, 10 Drawing Sheets

HEAT EXCHANGER

FIELD OF THE INVENTION

The present invention relates to a heat exchanger for use in a waste heat recovery system or EGR (exhaust gas recirculation) cooler.

BACKGROUND OF THE INVENTION

Heat exchangers are carried on waste heat recovery systems or EGR coolers. The heat exchangers carried on the waste heat recovery systems are designed such that heat of exhaust gas generated by engines warms cooling water, as disclosed in JP 2001-241872 A.

FIG. 15 hereof shows how to assemble a heat exchanger disclosed in JP 2001-241872 A. At first, a fin 101 having top and bottom portions 101*a*, 101*b* is inserted into a fin case 102 with brazing material applied onto the top and bottom portions 101*a*, 101*b*. Second, the fin case 102 is compressed to bring the fin 101 into contact with an interior surface of the fin case 102. Such a compressed fin case 102 is provided in plural. The compressed fin cases are inserted into end plates 103, 103 in such a manner that opposite ends of the compressed fin cases are held by the end plates 103, 103. The compressed fin cases with the opposite ends held by the enc plates 103, 103 are then housed in a core case 104. This core case 104 undergoes a brazing operation within a brazing furnace to form a heat exchanger 105.

The heat exchanger 105 is designed such that exhaust gas flows inside each of the fin cases 102 and cooling water flows outside each of the fin cases 102 so as to transfer heat of the exhaust gas to the cooling water.

One may propose improving heat transfer efficiency of the heat exchanger 105 by increasing the heat transfer area, for example, by providing each of the fin cases 102 with a pair of upper and lower fins 107*a*, 107*b*. The heat exchanger 105 having the upper and lower fins 107*a*, 107*b* will be discussed below with reference to FIG. 16.

As shown in FIG. 16, the fins 107*a*, 107*b* are housed in the fin case 102. The fin case 102 housing the fins 107*a*, 107*b* is provided in plural. The fin cases 102 are inserted into the end plates 106 and housed in the core case 104, in the manner as discussed above. The core case 104 is formed into a heat exchanger 105' by undergoing brazing operation in the manner as stated above to form a heat exchanger.

The heat exchanger 105' including the two fins 107*a*, 107*b* provides larger heat transfer area than the heat transfer area of the heat exchanger 105 having the single fin 101. As shown in FIG. 16, furthermore, the upper fin 107*a* has a bottom 108 which does not contact a top 109 of the lower fin 107*b*. The heat exchanger 105' with the bottom 108 spaced from the top 109 provides a larger heat transfer area than with the top 109 in contact with the top 109.

In manufacturing the heat exchanger having such fins 107*a*, 107*b*, however, the fin case 102 is subjected to a brazing operation with undesirable loads applied to the fin case 102 in a direction towards an inside of the fin case 102, as shown by arrows of FIG. 16. The application of the loads to the fin case 102 would plastically deform the fin case 102.

When the heat exchanger 105' is used for a waste heat recovery system, furthermore, cooling water flows around the fin case 102 in which case the fin case 102 would be plastically deformed under pressure from the cooling water.

There is a need for a heat exchanger having high strength in addition to providing a larger heat transfer area.

SUMMARY OF THE INVENTION

According to a first aspect of the present invention, there is provided a heat exchanger comprising: a core case; a plurality of fin cases disposed in side-by-side relation to each other within the core case, the fin cases being arranged such that a first heat medium flows inside each of the fin cases and a second heat medium flows outside each of the fin cases for heat transfer between the first heat medium and the second heat medium; a pair of upper and lower fins disposed within each of the fin cases, the upper and lower fins each having a cross-section of corrugated shape, the lower fin being disposed on a floor of each of the fin cases, the upper fin being disposed on the lower fin; the upper fin including: top portions joined to each of the fin cases, the top portions each having one end and an opposite end; bottom portions each having one end and an opposite end; rising portions each extending from the one end of each of the bottom portions to the one end of each of the top portions; falling portions each extending from the opposite end of each of the top portions to the opposite end of each of the bottom portions; and the bottom portions having respective first centerlines, the lower fin including: top portions each having one end and an opposite end; bottom portions joined to each of the fin cases, the bottom portions each having one end and an opposite end; rising portions each extending from the one end of each of the bottom portions to the one end of each of the top portions; falling portions each extending from the opposite end of each of the top portions to the opposite end of each of the bottom portions; and the top portions having respective second centerlines, the upper fin and the lower fin being oriented differently from each other such that the first centerlines intersect the second centerlines.

The upper fin and the lower fin are in contact with each other at locations where first centerlines intersect the second centerlines. At these locations, the upper and lower fins support each other to strengthen the fin case such that the fin case bears loads applied to the fin case in a direction towards an inside of the fin case. The upper fin and the lower fin have larger heat transfer area at locations where they are not in contact with each other. The heat exchanger including such upper and lower fins has larger heat transfer area and increased strength. In addition, heat of exhaust gas swirls within spaces defined between the upper and lower fins at the locations where the upper and lower fins are not in contact with each other.

In a preferred form of the present invention, the fin cases each include upper and lower case halves joined to each other, the upper fin being joined to the upper case half, the lower fin being joined to the lower case half.

The upper and lower fins are preliminarily secured to the upper and lower case halves, respectively, before the halves are joined together to form the fin case. The upper and lower fins are in tight contact with the fin case in contrast to fins housed in a fin case which is compressed after the fins have been housed in the fin case. This tight contact increases heat transfer efficiency. The upper and lower fins are readily appropriately positioned on the upper and lower case halves, respectively, before the case halves are joined together. Since the fins are readily appropriately positioned, productivity of the fin case can be improved.

In a further preferred embodiment, the fin cases each have an inlet and an outlet, and wherein adjacent ones of the first centerlines are located with one of the second centerlines being interposed between the adjacent ones of the first centerlines at each of the inlet and the outlet.

The first centerlines intersect the second centerlines only at one location which is the middle of the length of the fin case. The middle of the length of the fin case is supported by the upper and lower fins in such a manner as to bear the most one of loads applied to the fin case. The upper and lower fins have larger heat transfer area because the first centerlines intersect the second centerlines only at the one location.

According to a second aspect of the present invention, there is provided a heat exchanger comprising: a core case; a plurality of fin cases disposed in side-by-side relation to each other within the core case, the fin cases being arranged such that a first heat medium flows inside each of the fin cases and a second heat medium flows outside each of the fin cases for heat transfer between the first heat medium and the second heat medium; a pair of upper and lower fins disposed within each of the fin cases, the upper and lower fins each having a cross -section of corrugated shape, the lower fin being disposed on a floor of each of the fin cases, the upper fin being disposed on the lower fin; the upper fin including: top portions joined to each of the fin cases, the top portions each having one end and an opposite end; bottom portions each having one end and an opposite end; rising portions each extending from the one end of each of the bottom portions to the one end of each of the top portions; and falling portions each extending from the opposite end of each of the top portions to the opposite end of each of the bottom portions, the lower fin including: top portions each having one end and an opposite end; bottom portions joined to each of the fin cases, the bottom portions each having one end and an opposite end; rising portions each extending from the one end of each of the bottom portions to the one end of each of the top portions; and falling portions each extending from the opposite end of each of the top portions to the opposite end of each of the bottom portions, the upper fin having a pitch different from a pitch of the lower fin; and the top portions of the lower fin having contact portions being in contact with the bottom portions of the upper fin.

Since the pitch of the upper tin is different from the pitch of the lower fin, the upper and lower fins are in contact with each other at the small number of locations in contrast to fins having the same pitches. That is, the upper and lower fins are not in contact with each other at the large number of locations, and hence the upper and lower fins have larger heat transfer area. The lower fin is in contact with the upper fin at the contact portions. At the contact portions, the fins support each other to strengthen the fin case such that the fin case bears loads applied to the fin case in a direction towards an inside of the fin case. The heat exchanger including such upper and lower fins has larger heat transfer area and increased strength.

In a further preferred form of the present invention, the bottom portions of the upper fin, the rising portions of the upper fin or the falling portions of the upper fin have communicating holes formed therethrough while the top portions of the lower fin, the rising portions of the lower fin or the falling portions of the lower fin have communicating holes formed therethrough.

Through the communication holes, a space defined between the upper and lower fins communicates with spaces defined between the lower fin and the floor of the fin case and with spaces defined between the upper fin and a ceiling of the fin case. Within these spaces between the lower fin and the floor of the fin case and between the upper fin and the ceiling of the fin case, heat of exhaust gas may swirl.

BRIEF DESCRIPTION OF THE DRAWINGS

Certain preferred embodiments of the present invention will hereinafter be described in detail, by way of example only, with reference to the accompanying drawings, in which:

FIG. 5A is a view showing a plurality of fin cases attached to end plates while

FIG. 6A is a view showing that the core case of FIG. 5B is subjected to brazing operation within a brazing furnace while

FIG. 7A is a perspective view of a fin case according to a first embodiment of the present invention while

DETAILED DESCRIPTION OF THE PREFERRED EMBODIMENTS

Figure 1:
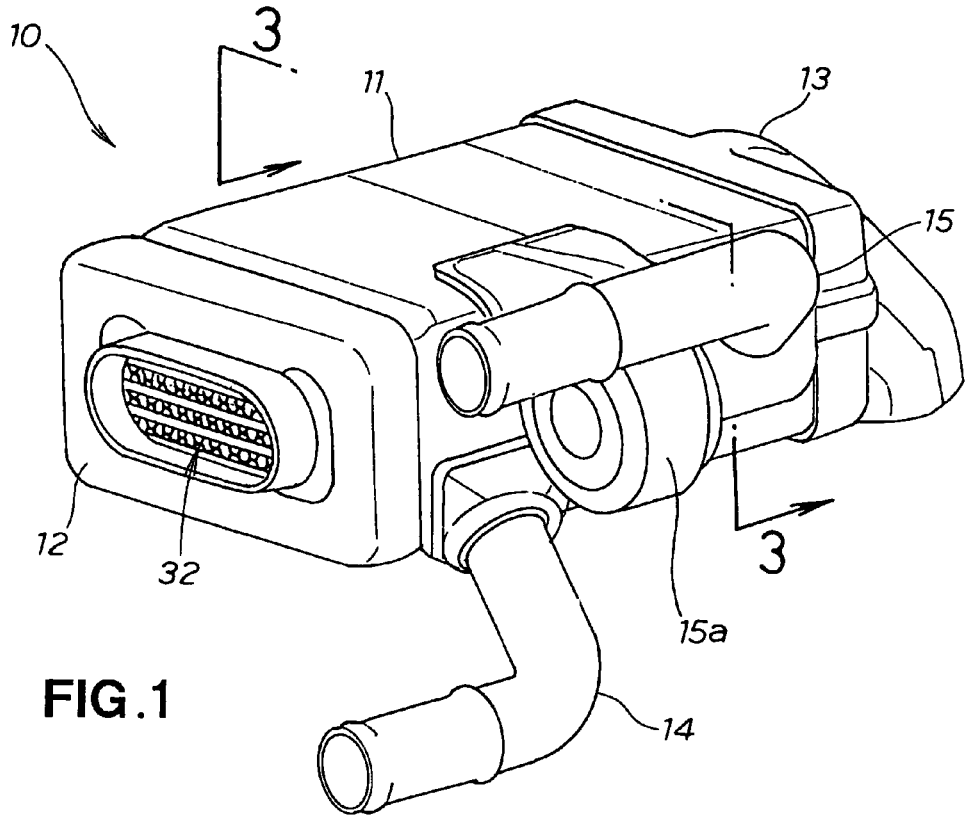
FIG. 1 is a perspective view of a heat exchanger according to the present invention.

Referring to FIG. 1, a heat exchanger 10 includes a core case 11. The core case 11 has a leading end secured to a gas inlet member 12 for allowing exhaust gas serving as a first heat medium to flow into the core case 11, and a trailing end secured to a gas outlet member 13 for allowing the exhaust gas to flow out of the core case 11. The exhaust gas is produced within an internal combustion engine and flows from the gas inlet member 12 through the core case 11 to the gas outlet member 13.

The heat exchanger 10 carries a cooling-water inlet conduit 14 attached to a lateral side thereof for allowing a cooling water to flow into the core case 11, and a cooling-water outlet conduit 15 attached to the lateral side for allowing the cooling water having passed through the core case 11 to flow out of the core case 11. The cooling water flows through the cooling-water inlet conduit 14 into the core case 11 for exchanging heat with the exhaust gas and then flows out of the core case 11 through the cooling-water outlet conduit 15. The heat exchanger 10, the gas inlet member 12, the gas outlet member 13, the cooling-water inlet conduit 14 and the cooling-water outlet conduit 15 are all incorporated into a waste heat recovery system 20 which will be discussed with reference to FIG. 2.

Figure 2:
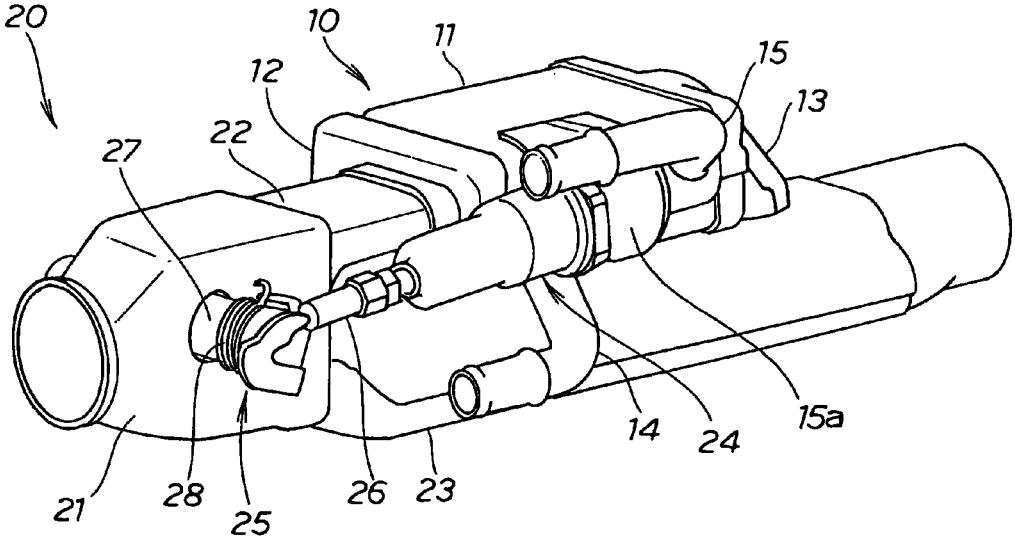
FIG. 2 is a perspective view of a waste heat recovery system including the heat exchanger shown in FIG. 1.

As shown in FIG. 2, the waste heat recovery system 20 includes an intake member 21 for taking in exhaust gas produced within the internal combustion engine. The system 20 also includes an upper passage member 22 interconnecting the intake member 21 and the gas inlet member 12, and a lower passage member 23 disposed below the heat exchanger 10 for allowing exhaust gas to flow through the lower passage member 23 when the exhaust gas does not flow into the upper passage member 22. The system 20 further includes a cooling-water outlet member 15*a* attached to the heat exchanger 10 for allowing cooling water which does not flow into the cooling-water outlet conduit 15 to flow through the cooling-water outlet member 15*a*, a thermoactuator 24 attached to the cooling-water outlet member 15*a* and operable in correspondence to temperature of the cooling-water flowing through the cooling-water outlet member 15*a*, and a valve mechanism 25 attached to a leading end of the thermoactuator 24 for controlling amount of exhaust gas to be delivered into the upper passage member 22.

Cooling water flowing out of the heat exchanger 10 is in part delivered through the cooling-water outlet member 15*a* into the thermoactuator 24. If the cooling water delivered into the thermoactuator 24 has a temperature higher than a predetermined temperature, a wax disposed in the thermoactuator 24 expands to thereby advance a piston rod 26 attached to a leading end of the thermoactuator 24. The advance of the piston rod 26 causes a shaft 27 of the valve mechanism 25 to rotate counterclockwise together with a valve attached to the shaft 27. The rotation of the valve closes the upper passage member 22. With the upper passage member 22 closed, exhaust gas which has passed through the intake member 21 is allowed to flow into the lower passage member 23.

If cooling water which has flowed into the thermoactuator 24 has a temperature lower than the predetermined temperature, the wax in the thermoactuator 24 contracts. With the wax contracted, the piston rod 26 is retracted under the action of a return spring disposed within the thermoactuator 24, such that the shaft 27 is forced by a spring 28 to rotate clockwise. Then, the valve attached to the shaft 27 rotates in such a direction as to close an inlet of the lower passage member 23. With the inlet of the lower passage member 23 closed, exhaust gas which has passed through the intake member 21 is allowed to flow into the heat exchanger 10 through the upper passage member 22.

Figure 3:
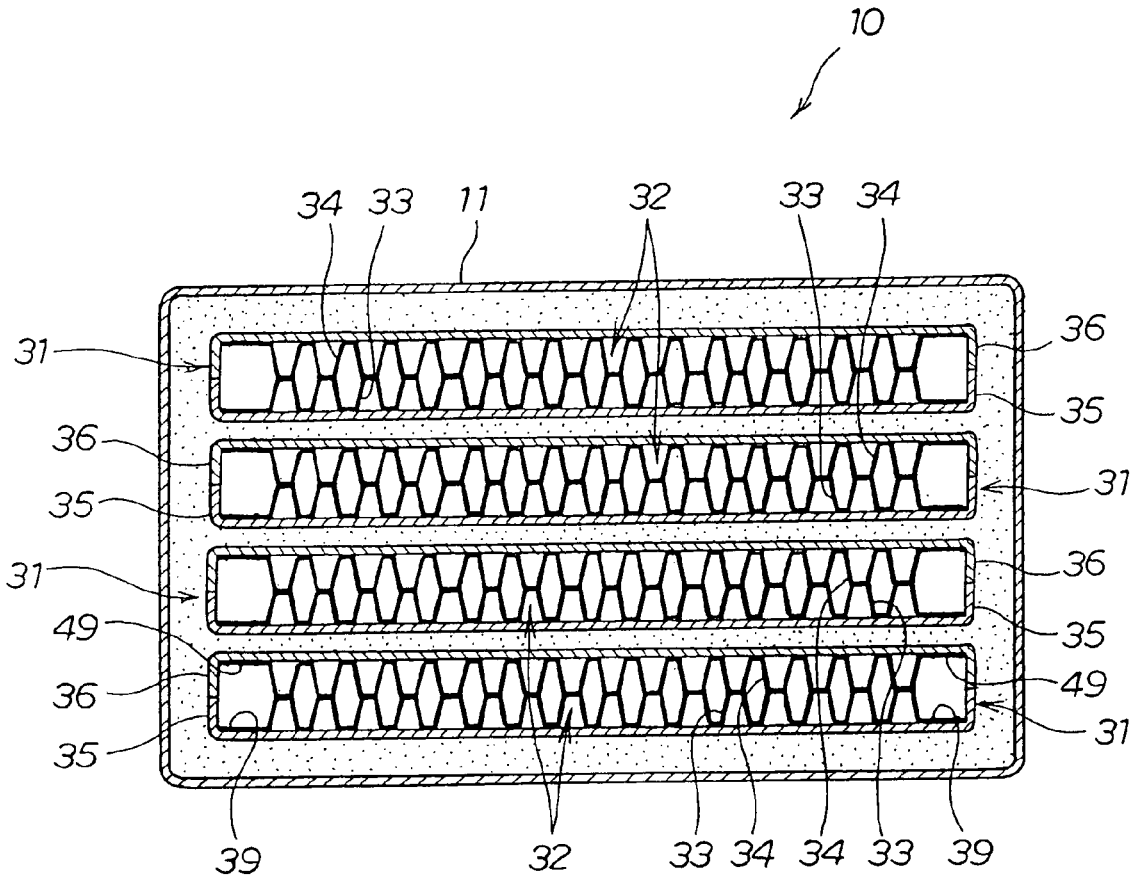
FIG. 3 is a cross-sectional view taken along line 3-3 of FIG. 3.

Reference is made to FIG. 3. Within the core case 11, a plurality of fin cases 31 are disposed in side-by-side relation to each other. Each of the fin cases houses a fin assembly 32.

The fin assembly 32 includes two fins of corrugated shape: one is a lower fin 33 disposed on a floor of the fin case 32, the other is an upper fin 34 disposed on the lower fin 33. The fin case 31 includes a lower case half 35 and an upper case half 36. The lower fin 33 is joined to the lower case half 35 while the upper fin 34 is joined to the upper case half 36.

The fin case 31 extends in a direction perpendicular to this sheet of FIG. 3. Inside the fin case 31 flows exhaust gas. Outside the fin case 31 flows cooling water. With the exhaust gas flowing inside the fin case 31, heat of the exhaust gas is transferred through the fin case 31 to the cooling water flowing outside the fin case 31. Disposition of the two fins 33, 34 in the fin case 31 increases heat transfer area to thereby improve heat transfer efficiency.

The lower fin 33 and the upper fin 34 each have a cross-section of corrugated shape such as trapezoidal or rectangular shape. The fin of corrugated-shaped cross-section is easy to manufacture, and hence is available at low cost. If the lower fin 33 and the upper fin 34 are identical to each other, these fins are cheaper than fins which are different from each other. In addition, provision of the fin of corrugated shape may allow exhaust gas to smoothly flow through the fin case 31, which results in a greater amount of exhaust gas flowing through the fin case 31 in a given period of time. The flow of exhaust gas of greater amount through the fin case 31 improves heat transfer efficiency.

The fin case 31 housing the fins 33, 34 are manufactured in a manner explained hereinbelow.

Figure 4A:
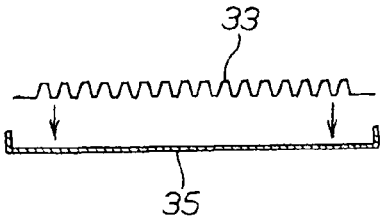
FIGS. 4A to 4F are views showing a method of manufacturing a fin case.

As shown in FIG. 4A, the lower fin 33 is disposed on the floor of the lower case half 35. In so doing, the lower fin 33 is positioned in a given orientation, as will be detailed later. The lower fin 33 is preliminarily secured at its opposite ends 39, 39 to the floor of the lower case half 35 by spot welding, as shown in FIG. 4B. The upper fin 34 is positioned in a given orientation and then preliminarily secured at its opposite ends 49, 49 (FIG. 4D) to the upper fin case half 36, as is the lower fin 33. The fins 33, 34 may be preliminarily secured to the lower and upper case halves 35, 36, respectively, by other than spot welding as long as the fins are secured to the case halves to such an extent that the fins are not displaced. It is desirable that the opposite ends of the fin are secured to the fin case half. Generally, it is difficult to make exhaust gas flow along opposite ends of a fin. With this in mind, the opposite ends of the fin according to the present invention are leveled and secured to the case half. Such leveled opposite ends of the fin provide flow paths having large areas sufficient to facilitate flow of exhaust gas along the opposite ends of the fin, which results in heat transfer efficiency being improved. In addition, the leveled opposite ends of the fin and the fin case define a larger space which can be effectively used.

Figure 4C:
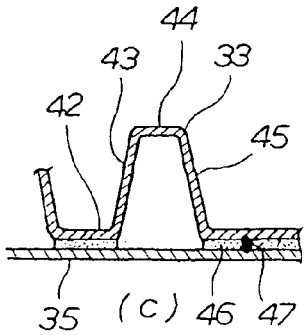
Figure 4B:
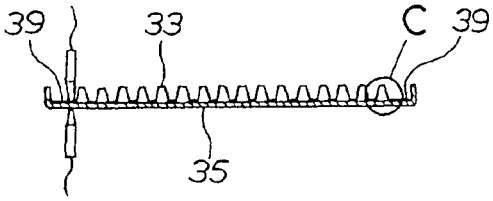

FIG. 4C is an enlarged view of a portion of the lower fin 33 encircled by a circle C of FIG. 4B. As shown in FIG. 4C, the lower fin 33 includes a bottom portion 42 joined to the lower case half 35, a top portion 44, a rising portion 43 extending from one end of the bottom portion 42 to one end of the top portion 44, and a falling portion 45 extending from an opposite end of the top portion 44 to one end of a bottom portion 42 located adjacent the aforementioned bottom portion 42.

Applied to the bottom portion 42 of the lower fin 33 is a brazing material 46 for brazing the bottom portion 42 to the lower case half 35. Reference numeral 47 designates a nugget produced when the lower fin 33 is preliminarily secured to the lower case half 35, as shown in FIG. 4B. Such a nugget 47 is produced in the upper fin, as in the case of the lower fin 33. The upper fin 34 is designed as is the lower fin 33.

Figure 4D:
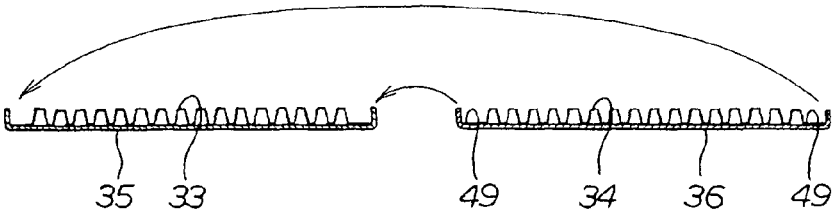
Figure 4E:
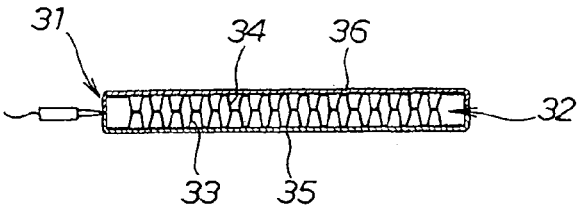
Figure 4F:
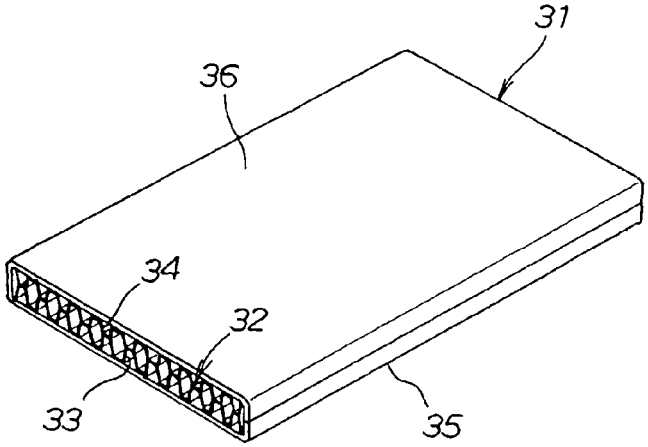

As shown in FIG. 4D, with opposite ends 49, 49 of the upper fin 34 preliminarily secured to the upper case half 36, the upper case half 36 is laid on the lower case half 35 with ends of the upper case half 36 aligned with ends of the lower case half 35. Then, the upper case half 36 and the lower case half 35 are welded together at the respective ends by such means as TIG welding, as shown in FIG. 4E, to thereby form the fin case 31 shown in FIG. 4F. It is to be noted that the upper case half 36 and the lower case half 35 may be joined together at the respective ends by such means as brazing or plasma welding rather than by the TIG welding.

The lower fin 33 is preliminarily secured to the lower fin case half 35 while the upper fin 34 is preliminarily secured to the upper fin case half 36 before the fin case halves 35, 36 are joined together. That is, since the fins 33, 34 are readily appropriately positioned on the case halves 35, 36 before the case halves 35, 36 are joined together, productivity of the fin case is improved. In addition, since the fins 33, 34 are preliminarily secured to the fin case halves 35, 36, respectively, before the case halves 35, 36 are joined together, these fins 33, 34 are in tight contact with the fin case 31 in contrast to fins in a fin case which is compressed after the fins have been housed in the fin case. That tight contact improves heat transfer efficiency.

The fin case 31 manufactured in the manner discussed with reference to FIG. 4A to FIG. 4F houses the fin assembly 32 to be subjected to brazing operation described hereinbelow.

Figure 5A:
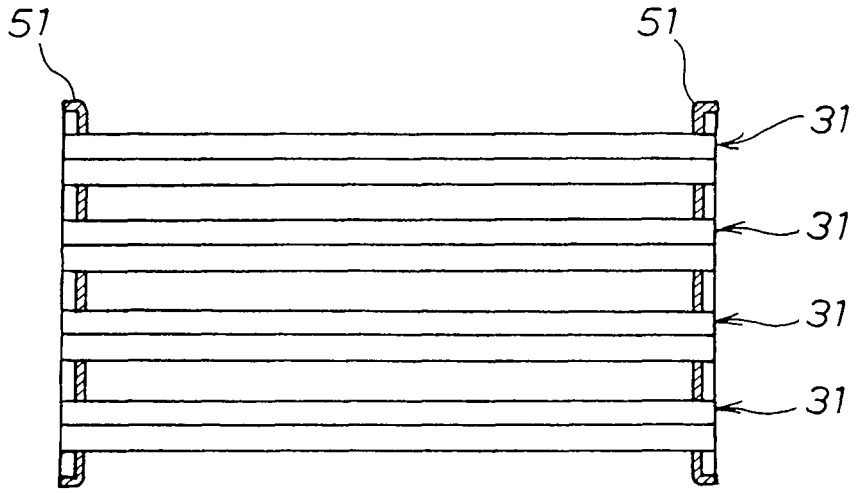
Figure 5B:
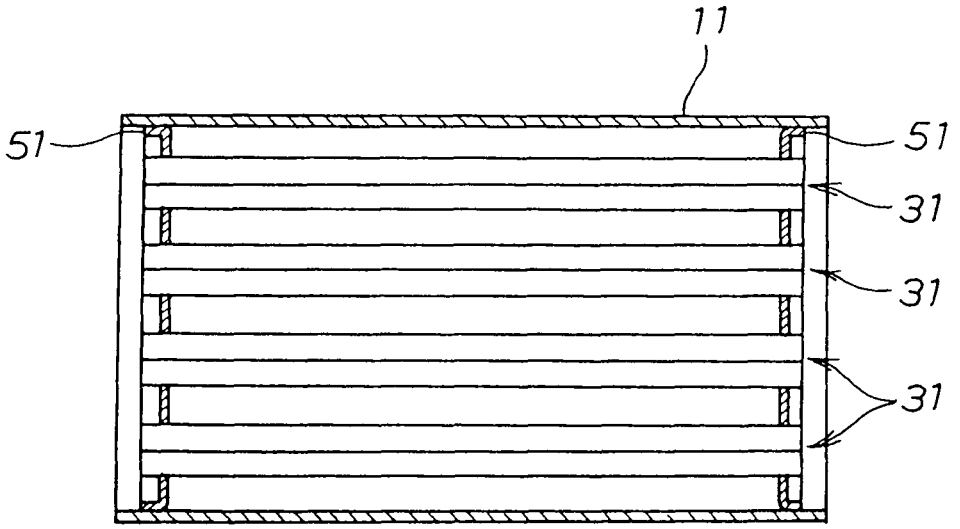
FIG. 5B is a view showing a core case housing the fin cases attached to the end plates.
Figure 6A:
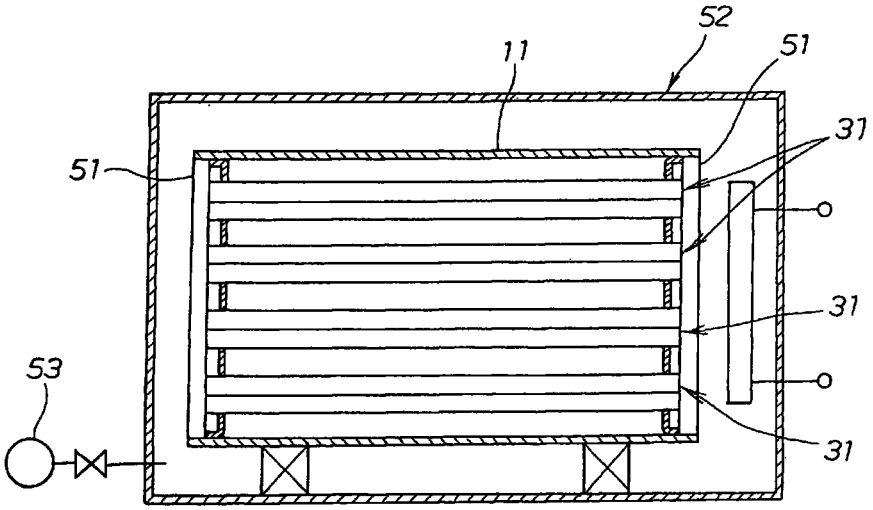
Figure 6B:
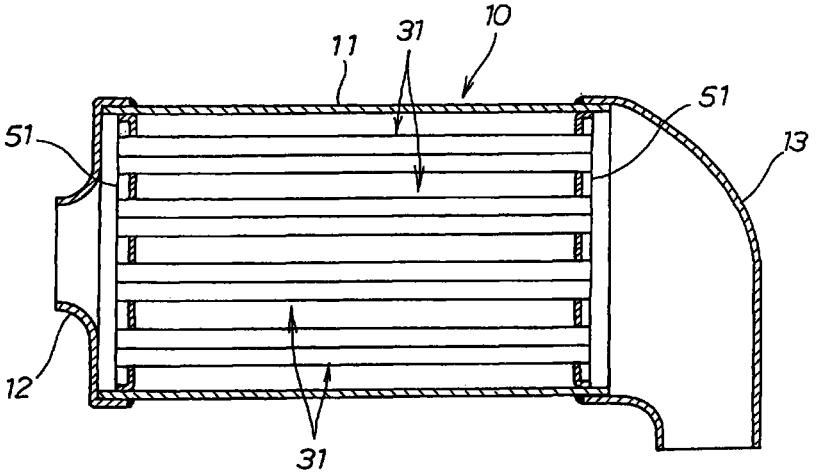
FIG. 6B is a view showing that a heat exchanger made by the brazing operation shown in FIG. 6A.

As shown in FIG. 5A, a plurality of fin cases 31 (i.e. four fin cases 31) are supported at their opposite ends by end plates 51, 51. The fin cases 31 supported by the end plates 51, 51 are housed in the core case 11, as shown in FIG. 5B. Then, the core case 11 housing the fin cases 31 supported by the end plate 51, 51 is subjected to the brazing operation within a brazing furnace 52, as shown in FIG. 6A. The brazing operation is performed in vacuum with air in the furnace 52 pumped out by a pump 53. When the brazing operation is finished, a heat exchanger 10 is completed, as shown in FIG. 6B. The gas inlet member 12 and the gas outlet member 13 are welded to this completed heat exchanger 10. The fin assembly 32 positioned in each fin case 31 of the heat exchanger 10 is arranged in the manner discussed hereinbelow.

Figure 7A:
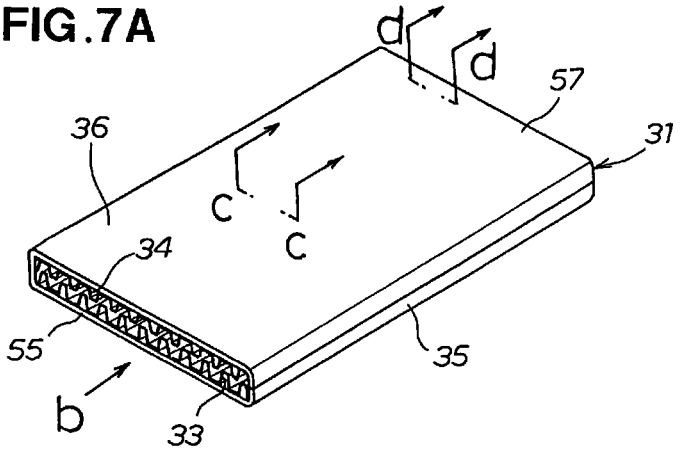

Turning to FIG. 7A, the lower fin 33 is brazed to the lower case half 35 while the upper fin 34 is brazed to the upper case half 36. The lower fin 33 and the upper fin 34 are oriented differently from each other.

Figure 7B:
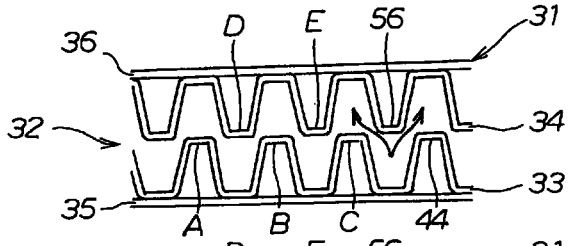
FIGS. 7B to 7D are cross-sectional views of the fin case shown in FIG. 7A.

FIG. 7B is a view showing an inlet 55 of the fin case 31 when the fin case 31 is viewed in a direction of an arrow b. At the inlet 55 of the fin case 31, the top portions 44 of the lower fin 33 and bottom portions 56 of the upper fin 34 are arranged alternately. The top portions 44 of the lower fin 33 shown in FIG. 7B include three ones designated at A, B and C while the bottom portions of the upper fin 34 include two ones designated at D and E.

At the inlet of the fin case 31, the bottom portion D of the upper fin 34 is disposed between the top portion A of the lower fin 33 and the top portion B of the lower fin 33 while the bottom portion E of the upper fin 34 is disposed between the top portion B of the lower fin 33 and the top portion C of the lower fin 33. That is, on an upstream side of flow of exhaust gas, the top portions 44 of the lower fin 33 and the bottom portions 56 of the upper fin 34 are alternately arranged in such a manner that the top portions 44 are not in contact with the bottom portions 56. With the top portions 44 spaced from the bottom portions 56, the lower fin 33 and the upper fin 34 have the maximum heat transfer area.

The alternate arrangement of the top portions 44 and the bottom portions 56 allows heat of exhaust gas to swirl within a space defined between the upper fin 34 and the lower fin 33, as indicated by arrows of FIG. 7A. The swirl of heat of exhaust gas results in uniform distribution of heat within the space defined between the upper fin 34 and the lower fin 33.

Figure 7C:
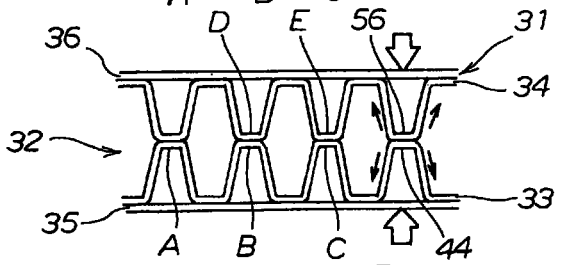

FIG. 7C is a cross-sectional view taken along line c-c of FIG. 7A. As shown in FIG. 7C, the bottom portions 56 of the upper fin 34 lie on the top portions 44 of the lower fin 33 at the middle of the length of the fin case 31. More specifically, the bottom portion D of the upper fin 34 is in contact with an upper surface of the top portion B of the lower fin 33 while the bottom portion E of the upper fin 34 is in contact with an upper surface of the top portion C of the lower fin 33 because the upper fin 34 and the lower fin 33 are oriented differently from each other.

The lower fin 33 and the upper fin 34 which are in contact with each other at the middle of the length of the fin case 31 support each other in such a manner as to enable the fin case 31 to withstand loads applied to the fin case 31 in a direction towards an inside of the fin case 31, as shown by arrows of FIG. 7C, when the fin case 31 is placed in a vacuum during the brazing operation or when cooling water flows around the fin case 31.

Figure 7D:
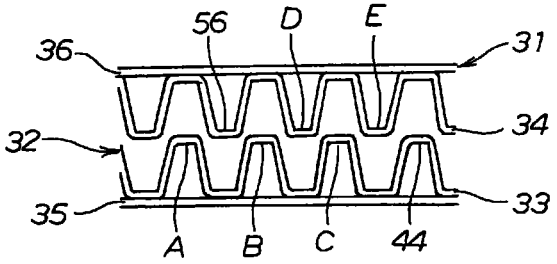

FIG. 7D is a cross-sectional view taken along line d-d of FIG. 7A. As shown in FIG. 7D, the top portions 44 of the lower fin 33 and the bottom portions 56 of the upper fin 34 are arranged alternately at an outlet 57 of the fin case 31. More specifically, the bottom portion D of the upper fin 34 is disposed between the top portion B of the lower fin 33 and the top portion C of the lower fin 33 while the bottom portion E of the upper fin 34 is disposed rightward of the top portion C of the lower fin 33.

From the foregoing descriptions made with reference to FIGS. 7B to 7D, it is understood that the upper and lower fins support each other at the middle of the length of the fin case 31 to reinforce the fin case 31 (see FIG. 7C) while the upper and lower fins have larger heat transfer area at locations where the upper fin is not in contact with the lower fin (FIGS. 7B and 7D). The heat exchanger including the upper and lower fins arranged in the manner as discussed above has larger heat transfer area and high strength. The lower fin 33 and the upper fin 34 are arranged in the different orientations discussed in relation to FIG. 8 which is a transparent view diagrammatically showing the inside of the fin case 31 when the fin case 31 is viewed from above.

Figure 8:
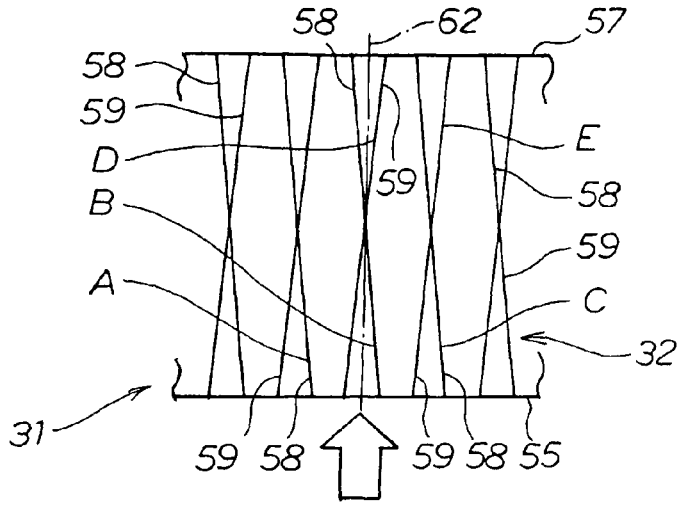
FIG. 8 is a transparent view diagrammatically showing an inside of the fin case with first centerlines of bottom portions of an upper fin intersecting second centerlines of top portions of a lower fin.

As shown in FIG. 8, the upper fin and the lower fin are oriented differently from each other such that first centerlines 58 of the respective bottom portions of the upper fin 34 intersect second centerlines 59 of the respective top portions of the lower fin 33.

At the inlet 55 and the outlet 57 of the fin case, one of the second centerlines 59 is located between adjacent ones of the first centerlines 58, 58. That is, the bottom portion D of the upper fin is located between the top portions A, B of the lower fin at the inlet 55 of the fin case 31 while the bottom portion D of the upper fin 34 is located between the top portions B, C of the lower fin 33 at the outlet 57 of the fin case 31. Each of the first centerlines 58 intersects each of the second centerlines 59 only at the middle of the length of the fin case.

The upper fin 34 is disposed such that each of the first centerlines 58 intersects a longitudinal axis 62 of the fin case 31. The lower fin 33 is disposed such that each of the second centerlines 59 intersects the axis 62 of the fin case 31. In other words, the upper fin (or lower fin) is shifted by one pitch with respect to the lower fin (or upper fin).

Although the upper and lower fins 34, 33 may be disposed such that each of the first centerlines 58 intersects more than one of the second centerlines 59, it is desirable that the respective first centerlines 58 intersect the respective second centerlines 59 only at one location, the middle of the length of the width of the fin case.

The upper and lower fins 34, 33 support the middle of the length of the fin case 31 to strengthen the fin case 31 such that the middle of the length of the fin case 31 bears the most one of the loads applied to the fin case (see FIG. 7C). With the respective first centerlines 58 intersecting the respective second centerlines 59 only at the one part (middle) of the length of the fin case, the upper and lower fins 34, 33 have larger heat transfer area than with the respective first centerlines 58 intersecting the respective second centerlines at more than one parts of the fin case.

Figure 9:
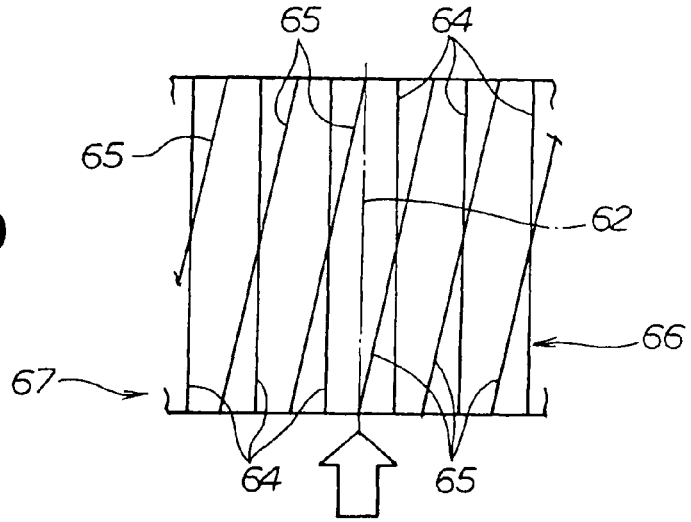
FIG. 9 is a transparent view diagrammatically showing an inside of a fin case according to a second embodiment of the present invention with first centerlines of bottom portions of an upper fin intersecting second centerlines of top portions of a lower fin.

FIG. 9 illustrates a fin assembly 66 including upper and lower fins according to the second embodiment of the present invention. As shown in FIG. 9, the lower fin is disposed such that each second centerline 64 is parallel to the axis 62 of the fin case. The upper fin is disposed such that each first centerline 65 intersects the axis 62.

A heat exchanger including the fin assembly 66 having the upper and lower fins disposed in the manner as shown in FIG. 9 has also larger heat transfer area and high strength.

The upper and lower fins support the middle of the length of a fin case 67 to strengthen the fin case 67 such that the middle of the length of the fin case 67 bears the most one of loads applied to the fin case. Since the first centerline 65 intersects the second centerline 64 only at one part of the fin case, the upper and lower fins have larger heat transfer area. It is noted that the lower fin is disposed such that the second centerline 64 intersects the axis 62 and the upper fin is disposed such that the first centerline 65 is parallel to the axis 62. A method of efficiently assembling a fin case according to a third embodiment of the present invention will be discussed hereinbelow.

Figure 10A:
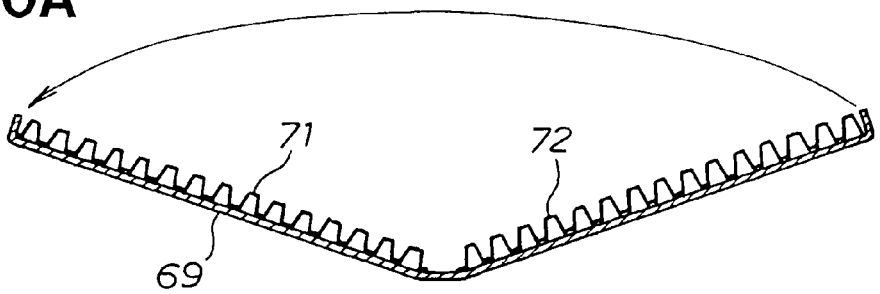
FIGS. 10A and 10B are views showing a method of forming a fin case according to a third embodiment of the present invention.
Figure 10B:
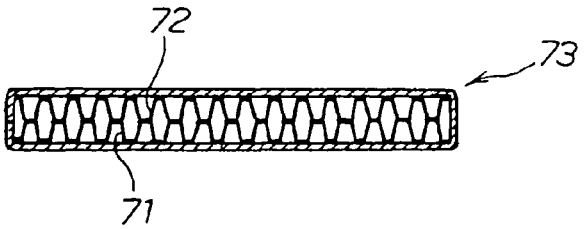

As shown in FIG. 10A, a lower fin 71 and an upper fin 72 are preliminarily secured to a fin case sheet 69 to be formed into a case-shaped configuration. With the fins 71, 72 secured to the sheet 69, the sheet 69 is folded in two in such a manner as to position opposite ends of the sheet 69 one over the other, as shown by an arrow. The opposite ends of the sheet 69 are welded together to form a fin case 73, as shown in FIG. 10B. The fin case 73 is formed by welding only one side of the folded sheet 69. The welding only one point of the folded sheet 69 requires a shorter time.

Figure 11:
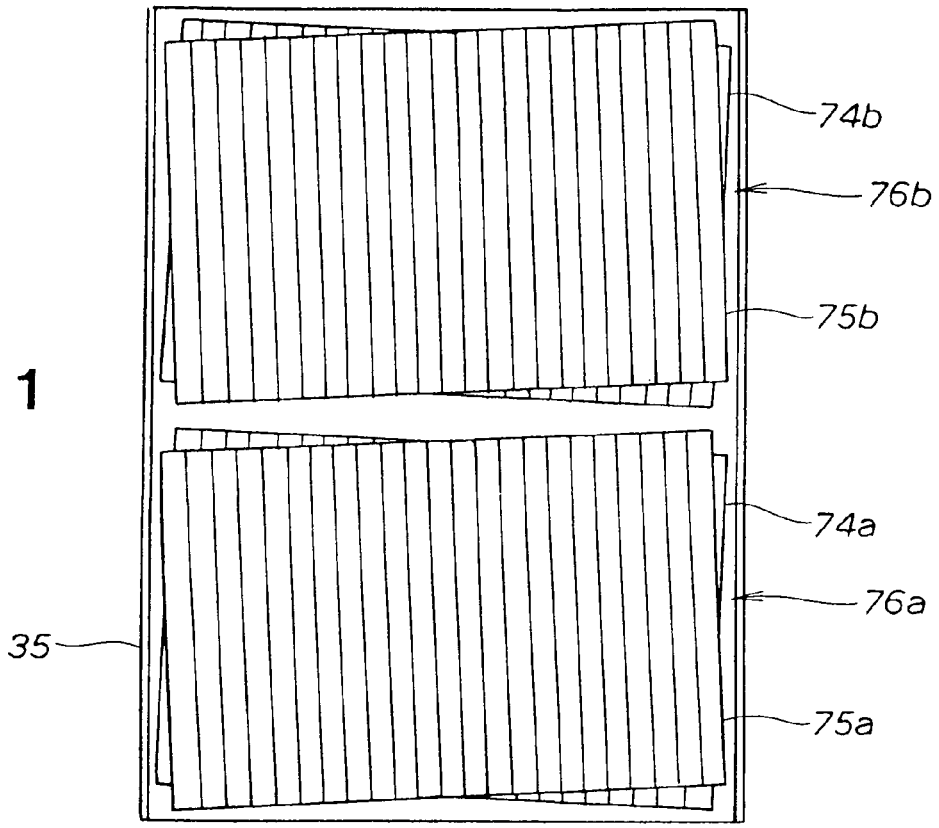
FIG. 11 is a view showing a fin case according to a fourth embodiment of the present invention.

FIG. 11 shows front and rear fin assemblies 76*a*, 76*b* according to a fourth embodiment of the present invention. The front fin assembly 76*a* is disposed on an upstream side of flow of the first heat medium while the rear fin assembly 76*b* is disposed rearward of the front fin assembly 76*a* and on a downstream side of flow of the first heat medium. The front fin assembly 76*a* includes a front lower fin 74*a* and a front upper fin 75*a* disposed on the front lower fin 74*a*. The rear fin assembly 76*b* includes a rear lower fin 74*b* and a rear upper fin 75*b* disposed on the rear lower fin 74*b*.

The fins 74*a*, 75*a* of the front fin assembly 76*a* and the fins 74*b*, 75*b* of the rear fin assembly 76*b* may have the same pitch. Such fins of the same pitch can advantageously correspond to fin cases of different sizes. There is no need to provide different sizes of fins for one of the fin cases of different sizes, which results in reduced cost.

The fins 74*b*, 75*b* of the rear fin assembly 76*b* may have a pitch smaller than that of the fins 74*a*, 75*a* of the front fin assembly 76*a*. In this case, even when the fins 74*a*, 75*a* of the front fin assembly 76*a* have a larger pitch, a heat exchange can be sufficiently achieved because exhaust gas (first heat medium) is high in temperature on the upstream side. Meantime, even when the fins 74*b*, 75*b* of the rear fin assembly 76*b* have a smaller pitch, the exhaust gas can sufficiently flow along the fins 74*b*, 75*b* because flow rate of the exhaust gas on the downstream side is reduced by decrease in temperature of the exhaust gas. The fins 74*b*, 75*b* of smaller pitch have larger heat transfer area to provide increased amount of heat transfer. Providing the fins 74*b*, 75*b* with the pitch smaller than the pitch of the fins 74*a*, 75*a* improves heat transfer efficiency.

Figure 12:
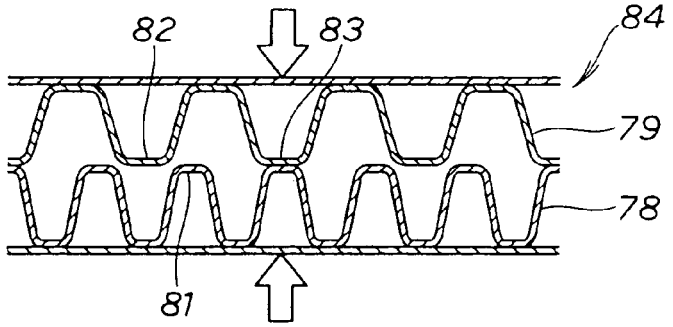
FIG. 12 is a cross-sectional view of upper and lower fins according to a fifth embodiment of the present invention.

FIG. 12 shows a lower fin 78 and an upper fin 79 according to a fifth embodiment of the present invention. As shown in FIG. 12, the lower fin 78 has a pitch different from that of the upper fin 79. In the illustrated embodiment, the pitch of the upper fin 79 is 1.5 times the pitch of the lower fin 78. The top portions 81 of the lower fin 78 have contact portions 83 being in contact with bottom portions 82 of the upper fin 79.

With the pitch of the lower fin 78 different from the pitch of the upper fin 79, the top portions 81 of the lower fin 78 are not in contact with the bottom portions of the upper fin 79 at any portion other than the contact portions 83. With the pitch of the lower fin 78 being different from the pitch of the upper fin 79, therefore, the upper and lower fins 79, 78 have the same advantageous result as that produced by the upper and lower fins which have been previously discussed, even if the upper and lower fins 79, 78 are disposed in the same orientation. That is, the upper and lower fins 79, 78 support each other to strengthen a fin case 84 such that the fin case 84 bears loads applied to the fin case 84 in a direction towards the inside of the fin case 84, as shown by arrows of FIG. 12. The lower fin 78 is in contact with the upper fin 79 only at the contact portions 83. That is, the upper and lower fins 79, 78 are not in contact with each other at locations other than the contact portions 83, as discussed above. At such locations, the upper and lower fins 79, 78 have larger heat transfer area. A heat exchanger including such upper and lower fins 79, 78 according to the fifth embodiment of the present invention has larger heat transfer area and high strength.

The upper fin 79 may be disposed in a different orientation from an orientation in which the lower fin 78 is disposed, as shown in FIG. 8, even if the pitch of the upper fin 79 is different from the pitch of the lower fin 78. In this case, the upper fin 79 and the lower fin 78 define a larger space therebetween. Within such a larger space, heat of exhaust gas may swirl.

Figure 13:
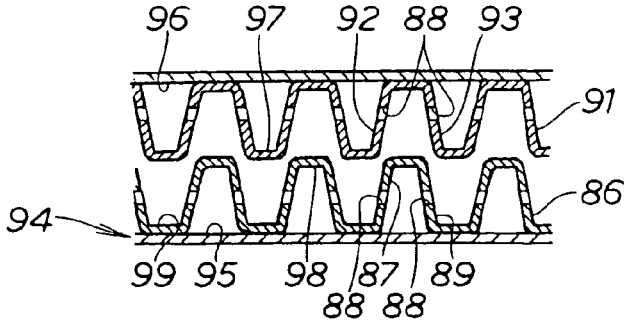
FIG. 13 is a cross-sectional view of upper and lower fins according to a sixth embodiment of the present invention.

FIG. 13 shows upper and lower fins 86, 91 according to a sixth embodiment of the present invention. The lower fin 86 includes rising portions 87 having communication holes 88 formed therethrough, and falling portions 89 having communication holes 88 formed therethrough. Similarly, the upper fin 91 includes rising portions 92 having communication holes 88 formed therethrough, and falling portions 93 having communication holes 88 formed therethrough.

Through the communication holes 88, a space defined between the lower fin 86 and the upper fin 91 communicates with spaces defined between the lower fin 86 and a floor 95 of a fin case 94 and with spaces defined between the upper fin 91 and a ceiling 96 of the fin case 94. Thus, heat of exhaust gas can swirls not only in the space defined between the upper and lower fins 86, 91 but also in spaces defined between the lower fin 86 and the floor 95 of the fin case 94 and between the upper fin 91 and the ceiling 96 of the fin case 94. The upper fin 91 has bottom portions 97 while the lower fin 86 has top portions 98. The bottom portions 97 and the top portions 98 may have communication holes 88 formed therethrough. These communication holes 88 may be formed by, for example, punching, slitting or louvering operation on the upper and lower fins 91, 86.

Figure 14A:
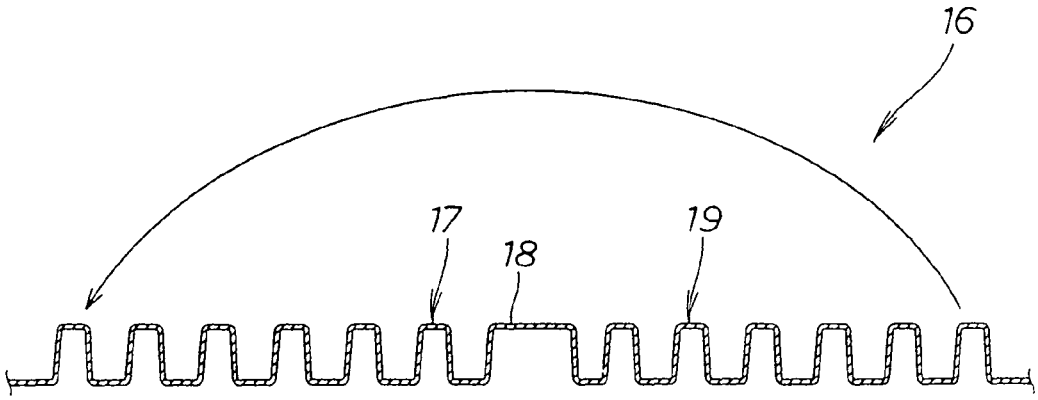
FIGS. 14A and 14B are views showing a method of forming upper and lower fins according to a seventh embodiment of the present invention.
Figure 14B:
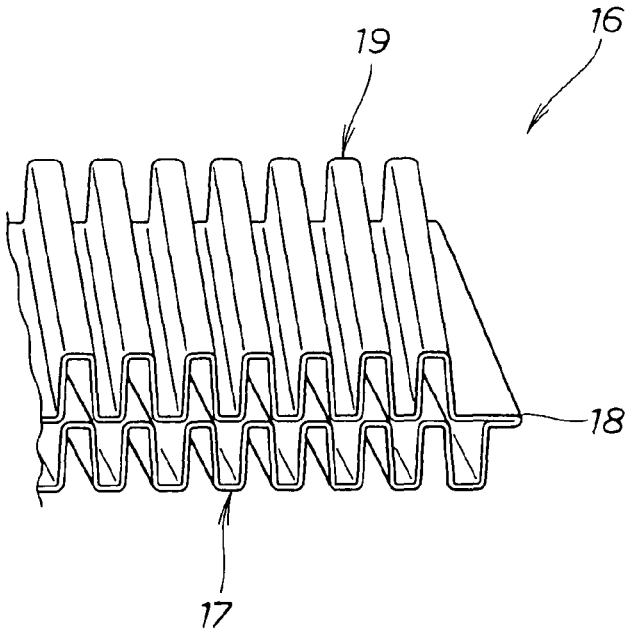
Figure 15:
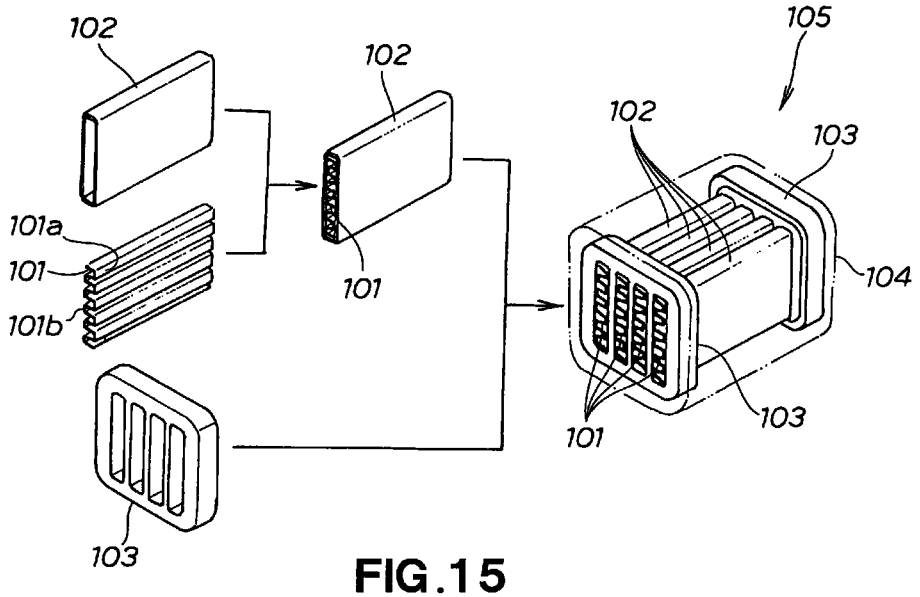
FIG.15 (PRIOR ART)
FIG. 15 is a view showing a method of forming a conventional heat exchanger.
Figure 16:
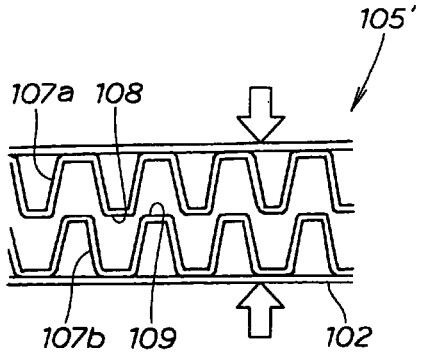
FIG.16 (PRIOR ART)
FIG. 16 is a cross-sectional view of another conventional heat exchanger.

FIGS. 14A and 14B show a fin assembly 16 according to a seventh embodiment of the present invention. The fin assembly 16 is folded in two, as shown by an arrow of FIG. 14A, to form a lower fin 17, an upper fin 19 disposed on the lower fin 17, and a fold 18 interconnecting the lower fin 17 and the upper fin 19, as shown in FIG. 14B.

The upper fin 19 includes bottom portions having respective first centerlines. The lower fin 17 includes top portions having respective second centerlines. The upper fin 19 and the lower fin 17 are in contact with each other at one location of the fin assembly 16 where the first centerlines intersect the second centerlines. At such a location, the upper and lower fins 19, 17 support each other to strengthen a fin case such that the fin case bears loads applied to the fin case in a direction towards an inside of the fin case. The upper and lower fins 19, 17 are in contact with each other only the one location of the fin assembly 16, as discussed above. That is, the upper and lower fins 19, 17 are not in contact with each other at locations of the fin assembly 16 other than the one location. At these locations where the upper and lower fins 19, 17 are not in contact with each other, the upper and lower fins 19, 17 have larger heat transfer area. A heat exchanger including the upper and lower fins 19, 17 according to the seventh embodiment of the present invention has larger heat transfer and high strength.

Heat of exhaust gas may swirl in a space defined between the upper fin 19 and the lower fin 17 at the locations where the upper fin 19 is not in contact with the lower fin 17. Positioning the upper fin 19 in place on the lower fin 17 requires only folding the fin assembly 16 in two. The upper fin 19 and the lower fin 17 can be formed in a shorter time because only one step of folding the fin assembly 16 in two is performed to position the upper fin 19 in place on the lower fin 17.

The heat exchanger according to the present invention has been described as being used in a heat recovery system. It is noted that the heat exchanger of the present invention may also be used in the EGR cooler. The heat exchanger is not limited to one used for a heat recovery system or an EGR cooler. The heat exchanger according to the present invention is suitable for use in systems and coolers other than a heat recovery system and an EGR cooler.

Obviously, various minor changes and modifications of the present invention are possible in light of the above teaching. It is therefore to be understood that within the scope of the appended claims the invention may be practiced otherwise than as specifically described.

What is claimed is:

1. A heat exchanger comprising:

a core case;

a plurality of fin cases disposed in side-by-side relation to each other within the core case, each of the fin cases having an inlet and an outlet and a length extending from the inlet to the outlet, and the fin cases being arranged such that a first heat medium flows inside each of the fin cases and a second heat medium flows outside each of the fin cases for heat transfer between the first heat medium and the second heat medium; and a pair of upper and lower fins disposed within each of the fin cases, the upper and lower fins each having a cross-section of corrugated shape, each lower fin being disposed on a floor of the corresponding fin case, each upper fin being disposed on the corresponding lower fin;

wherein each upper fin includes:

top portions joined to the corresponding fin case, each top portion having one end and an opposite end;

bottom portions having respective first centerlines, each bottom portion having one end and an opposite end;

rising portions each extending from the one end of each of the bottom portions to the one end of each of the top portions; and falling portions each extending from the opposite end of each of the top portions to the opposite end of each of the bottom portions;

wherein each lower fin includes:

top portions having respective second centerlines, each top portion having one end and an opposite end;

bottom portions joined to the corresponding fin case, each bottom portion having one end and an opposite end;

rising portions each extending from the one end of each of the bottom portions to the one end of each of the top portions; and falling portions each extending from the opposite end of each of the top portions to the opposite end of each of the bottom portions; and wherein for each of the fin cases, the upper fin and the lower fin are oriented differently from each other such that the first centerlines intersect the second centerlines only at one location corresponding to the middle of the length of the fin case.

2. The heat exchanger of claim 1, wherein each of the fin cases includes upper and lower case halves joined to each other, the upper fin being joined to the upper case half, and the lower fin being joined to the lower case half.

3. The heat exchanger of claim 1, wherein for each of the fin cases, adjacent ones of the first centerlines are located with one of the second centerlines being interposed between two adjacent ones of the first centerlines at each of the inlet and the outlet.

4. The heat exchanger of claim 1, wherein for each of the fin cases, the bottom portions, the rising portions or the falling portions of the upper fin have communicating holes formed therethrough; and wherein for each of the fin cases, the top portions, the rising portions, or the falling portions of the lower fin have communicating holes formed therethrough.

5. A heat exchanger comprising:

a core case;

a plurality of fin cases disposed in side-by-side relation to each other within the core case, each of the fin cases having an inlet and an outlet and a length extending from the inlet to the outlet, and the fin cases being arranged such that a first heat medium flows inside each of the fin cases and a second het medium flows outside each of the fin cases for heat transfer between the first heat medium and the second heat medium; and a pair of upper and lower fins disposed within each of the fin cases, the upper and lower fins each having a cross-section of corrugated shape, each lower fin being disposed on a floor of the corresponding fin case, each upper fin being disposed on the corresponding lower fin;

wherein the upper fin includes:

top portions joined to the corresponding fin case, each top portion having one end and an opposite end;

bottom portions each having one end and an opposite end;

rising portions each extending from the one end of each of the bottom portions to the one end of each of the top portions; and falling portions each extending from the opposite end of each of the top portions to the opposite end of each of the bottom portions;

wherein the lower fin includes:

top portions each having one end and an opposite end;

bottom portions joined to the corresponding fin case, the bottom portions each having one end and an opposite end;

rising portions each extending from the one of each of the bottom portions to the one end of each of the top portions; and falling portions each extending from the opposite end of each of the top portions to the opposite end of each of the bottom portions;

wherein for each of the fin cases, the upper fin has a pitch different from a pitch of the lower fin; and wherein for each of the fin cases, the top portions of the lower fin have contact portions in contact with the bottom portions of the upper fin only at one location corresponding to the middle of the length of the fin case.

6. The heat exchanger of claim 5, wherein for each of the fin cases, the bottom portions, the rising portions or the falling portions of the upper fin have communicating holes formed therethrough; and wherein for each of the fin cases, the top portions, the rising portions, or the falling portions of the lower fin have communicating holes formed therethrough.

7. The heat exchanger according to claim 1, wherein at each of the inlet and outlet of each of the fin cases, the top portions of the lower fin and bottom portions of the upper fin are arranged alternately with one another; and wherein at the middle part of the length of each of the fin cases, the bottom portions of the upper fin are in contact with respective ones of the top portions of the lower fin.

8. The heat exchanger according to claim 1, wherein for each of the fin cases, the upper and lower fins are in contact with each other at locations where the first centerlines intersect the second centerlines.

9. The heat exchanger according to claim 1, wherein for each of the fin cases, the upper and lower fins are in contact with each other at the middle part of the length of the fin case and are not in contact with each other at each of the inlet and outlet of the fin case.

10. The heat exchanger according to claim 1, wherein for each of the fin cases, the first and second centerlines intersect a longitudinal axis of the fin case.

11. The heat exchanger according to claim 1, wherein for each of the fin cases, the upper fin is disposed so that the first centerlines intersect a longitudinal axis of the fin case and the lower fin is disposed so that the second centerlines are parallel to the longitudinal axis of the fin case.

12. The heat exchanger according to claim 5, wherein at each of the inlet and outlet of each of the fin cases, the top portions of the lower fin and bottom portions of the upper fin are arranged alternately with one another.

13. The heat exchanger according to claim 5, wherein for each of the fin cases, the upper and lower fins are not in contact with each other at each of the inlet and outlet of the fin case.

14. A heat exchanger comprising:

a core case;

at least one fin case disposed in the core case, the at least one fin case having an inlet part, an outlet part, and a middle part disposed between the inlet and outlet parts; and a pair of upper and lower fins each having top and bottom portions, the upper and lower fins being disposed within the at least one fin case so that the upper and lower fins are not in contact with each other at the inlet and outlet parts of the at least one fin case and so that the bottom portions of the upper fin are in contact with respective ones of the top portions of the lower fin at the middle part of the at least one fin case;

wherein the bottom portions of the upper fin have respective first centerlines and the top portions of the lower fin have respective second centerlines; and wherein the upper and lower fins are oriented relative one another so that the first centerlines intersect the second centerlines only at one location corresponding to the middle of the length of the at least one fin case.

15. The heat exchanger according to claim 14, wherein each of the bottom portions of the upper fins and the top portions of the lower fin have communicating holes formed therethrough.

16. The heat exchanger according to claim 14, wherein the at least one fin case includes upper and lower case halves joined to each other, the upper fin being joined to the upper case half and the lower fin being joined to the lower case half.

* * * * *